US007825352B2

(12) United States Patent
Last et al.

(10) Patent No.: US 7,825,352 B2
(45) Date of Patent: Nov. 2, 2010

(54) GLOW PLUG PROVIDED WITH A PRESSURE SENSOR

(75) Inventors: Bernd Last, Reutlingen (DE); Cyrille Patri, Toulouse (FR); Alain Ramond, Merville (FR); John Burrows, Cheshire (GB); Sandro Goretti, Rubiera (IT)

(73) Assignees: Continental Automotive France, Toulouse (FR); Federal-Mogul Ignition Srl, Carpi, (MO) (IT)

( * ) Notice: Subject to any disclaimer, the term of this patent is extended or adjusted under 35 U.S.C. 154(b) by 738 days.

(21) Appl. No.: 11/587,659

(22) PCT Filed: Apr. 19, 2005

(86) PCT No.: PCT/FR2005/000932

§ 371 (c)(1),
(2), (4) Date: Mar. 8, 2007

(87) PCT Pub. No.: WO2005/111501

PCT Pub. Date: Nov. 24, 2005

(65) Prior Publication Data

US 2007/0227487 A1 Oct. 4, 2007

(30) Foreign Application Priority Data

Apr. 27, 2004 (FR) ..... 04 04463

(51) Int. Cl.
*F23Q 7/22* (2006.01)

(52) U.S. Cl. ..... 219/270; 123/179.6; 123/145 A

(58) Field of Classification Search ..... 60/212, 60/286, 303; 123/289, 305, 143 R, 143 C, 123/179.6, 145 A; 219/260, 270, 544, 541
See application file for complete search history.

(56) References Cited

U.S. PATENT DOCUMENTS

| | | | | |
|---|---|---|---|---|
| 4,944,271 | A * | 7/1990 | Iwata et al. | 123/406.41 |
| 6,575,039 | B2 * | 6/2003 | Murai et al. | 73/756 |
| 6,979,801 | B2 * | 12/2005 | Okazaki et al. | 219/270 |
| 7,207,214 | B1 * | 4/2007 | Wlodarczyk | 73/114.19 |
| 7,431,003 | B2 * | 10/2008 | Ludwig et al. | 123/145 A |
| 7,444,973 | B2 * | 11/2008 | Boucard et al. | 123/179.6 |
| 2004/0182144 | A1 * | 9/2004 | Okazaki et al. | 73/118.1 |
| 2004/0182145 | A1 * | 9/2004 | Okazaki et al. | 73/119 R |
| 2007/0163329 | A1 * | 7/2007 | Last et al. | 73/35.12 |
| 2007/0227486 | A1 * | 10/2007 | Boucard et al. | 123/145 A |
| 2007/0228030 | A1 * | 10/2007 | Boucard et al. | 219/270 |

FOREIGN PATENT DOCUMENTS

| | | | |
|---|---|---|---|
| EP | 1 096 141 | | 5/2001 |
| FR | 2 831 243 | A1 | 4/2003 |
| JP | 59 060237 | | 4/1984 |
| JP | 59 134341 | | 8/1984 |
| JP | 4-332313 | A | 11/1992 |
| JP | 9-72811 | A | 3/1997 |
| JP | 2002-364847 | A | 12/2002 |

* cited by examiner

*Primary Examiner*—Reginald L Alexander
(74) *Attorney, Agent, or Firm*—Young & Thompson

(57) ABSTRACT

A glow plug including a tubular body with elements for fixing it into a bore, an intermediate tubular part arranged inside the tubular body, a finger disposed inside the intermediate tubular part with a heating electrode, and a pressure sensor connected to the intermediate tubular part, wherein a face of the sensor facing the finger is pressed thereto.

17 Claims, 2 Drawing Sheets

GLOW PLUG PROVIDED WITH A PRESSURE SENSOR

The present invention concerns a glow plug comprising a pressure sensor

BACKGROUND OF THE INVENTION

In an internal combustion engine, in particular a Diesel engine, it has been noted that knowledge of the value of the pressure within each cylinder makes it possible to better control the progress of the combustion in the engine. This information is then used to regulate the injection of fuel in each of the cylinders. The polluting emissions of the engine may thus be reduced and the consumption optimized.

In an engine of Diesel type, each cylinder comprises a glow plug which makes it possible to heat the inside of the corresponding combustion chamber, in particular on starting the engine. This glow plug is disposed in a threaded bore which passes through the cylinder head of the engine. IT is already known to the person skilled in the art to integrate a pressure sensor into a glow plug. In this way, the bore formed in the cylinder head to receive the glow plug also serves to accommodate a device for measuring the pressure within the combustion chamber. Forming an additional bore in the cylinder head is thus avoided. Forming such a bore would create numerous problems due in particular to the lack of space as well as problems of cost, fluid-tightness, accessibility, etc.

A glow plug generally comprises a tubular body having on its outer surface a threaded portion enabling it to be fixed into a corresponding bore formed in the cylinder head. One portion of that body is then located within the combustion chamber and the other portion outside it. The portion within the combustion chamber bears a finger within which is located a heater electrode. This electrode is supplied by a core which passes through the tubular body of the glow plug. The portion outside the combustion chamber is also termed glow plug head. At that head, the core is connected to a source of electrical energy. It is also known to situate a pressure sensor at that head. This sensor then measures the pressure exerted on the finger of the glow plug. The principle is to measure the force exerted on the finger by the ambient pressure in the combustion chamber by a measurement of the stresses between the body of the glow plug and the finger. FIG. 1 appended hereto represents an embodiment of a glow plug of the prior art provided with a pressure sensor.

In this embodiment of the prior art, described in more detail below, the pressure sensor is disposed between the body of the glow plug on which it bears and a nut fastened to the upper end of the core supplying the pre-heating electrode with electrical energy. In this embodiment, the core passes through the sensor.

Such a glow plug of the prior art makes it possible to measure the pressure exerted within the combustion chamber on the glow plug finger. However, other signals become superposed on the signal corresponding to the pressure measured. To make a correct measurement of the ambient pressure within the combustion chamber of the cylinder considered, the background noise perturbing the pressure measurement should be excluded. This noise arises for example from the deformations of the cylinder head in which the glow plug is mounted.

SUMMARY OF THE INVENTION

The present invention is thus directed to providing a glow plug having a pressure sensor for which the signal corresponding to the pressure measured is not perturbed by parasite signals.

To that end, it provides a glow plug comprising:

a tubular body having means enabling it to be fixed into a bore, a finger arranged inside the body of the glow plug and receiving a heater electrode, and a pressure sensor.

According to the invention this glow plug further comprises an intermediate tubular part; the finger is disposed within the intermediate tubular part; the intermediate tubular part is mounted in the tubular body; the sensor is connected by its face that faces away from the finger to the intermediate tubular part, and the face of the sensor facing the finger bears on the latter.

The fact of providing the glow plug with an intermediate tubular part mounted as stated above makes it possible to decouple the finger and the body of the glow plug. The pressure sensor may then measure the stresses arising from the thrust exerted by the ambient pressure in the corresponding combustion chamber without being hindered by the stresses existing at the bore in which the glow plug is fixed and which are partly transferred to the body of that glow plug.

The invention also provides for the intermediate tubular part to be fastened to the tubular body for example in the vicinity of the end of the tubular body adapted to be located in the combustion chamber of the corresponding engine. This zone of the tubular body is not in general subject to external stresses and the intermediate tubular part thus does not undergone such stresses.

In a preferred embodiment, the intermediate part is fixed to the tubular body by an interference fit. In this way, the fixing to the tubular body is excellent. Fixing by welding may also be envisaged here. Similarly, the finger may be fixed to the intermediate part by an interference fit or by welding.

For better sensitivity for the measurement of pressure at the pressure sensor, the intermediate tubular part has a deformation zone between a first fixing zone in which the finger is fastened to the intermediate tubular part and a second fixing zone in which the intermediate tubular part is fastened to the tubular body. This deformation zone gives the freedom of movement to the finger and avoids creating tension between the intermediate tubular part and the finger which would be detrimental to the measurement of pressure between those two parts.

To transmit the forces exerted by the pressure of the combustion chamber on the finger of the glow plug, one embodiment provides that a spacer be disposed between the finger and the corresponding face of the sensor within the intermediate tubular part. This spacer must be rigid in order to be able to pass on high stresses. Furthermore, it must not perturb the measurement of the pressure by its vibrations. It thus has its own vibration frequency which is very different from the bandwidth of the pressure sensor. To satisfy these demands, the spacer is for example formed from a ceramic material.

The spacer referred to above may take the form of an elongate tubular bush of which the outer diameter is less than the inner diameter of the intermediate tubular part and terminates at the end adapted to come into contact with the pressure sensor with a frusto-conical portion so as to present a bearing surface adjacent to the sensor substantially corresponding to the surface of the sensor. In this embodiment, a single part is disposed between the finger and the sensor. This is of course favorable to good transmission of the forces but also enables easier assembly of the glow plug.

In the glow plug according to the invention, the sensor is preferably placed in a housing provided for that purpose in the intermediate tubular part, adjacent to the opposite end of that part from the end adapted to receive the finger and the sensor is for example connected to the intermediate tubular part by a nut having a screw thread on its outer periphery engaged in a tapping made in the inner end of the intermediate tubular part. In the case in which a spacer is provided between the finger and the sensor, the nut may clamp the sensor against that spacer.

The present invention also concerns an internal combustion engine, in particular an engine of Diesel type, characterized in that it comprises a glow plug as described above.

BRIEF DESCRIPTION OF THE DRAWINGS

Details and advantages of the present invention will appear more clearly from the following description, made with respect to the accompanying drawings in which.

DETAILED DESCRIPTION OF THE PREFERRED EMBODIMENTS

Figure 1:
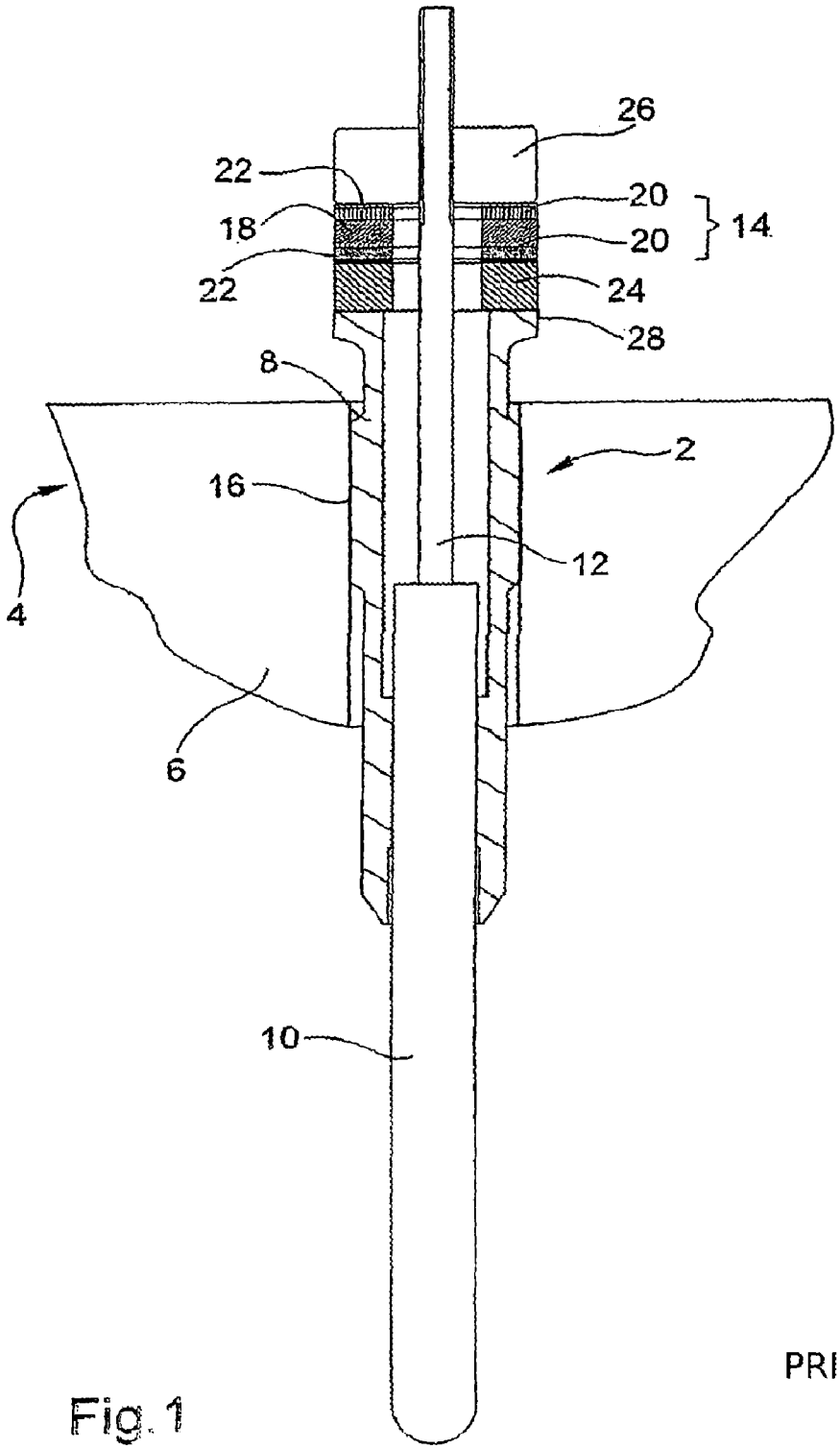
PRIOR ART Fig. 1
FIG. 1 represents a glow plug of the prior art.

FIG. 1 represents a glow plug of the prior art in longitudinal cross-section comprising a pressure sensor so as to be able to measure the pressure in an engine cylinder. This glow plug 2 is mounted in a conventional manner in an engine 4, of Diesel type, and more particularly in a cylinder head of that engine. It comprises a body 8, a finger 10, a core 12 and a pressure sensor 14.

The body 8 is adapted to be fixed to the engine by screwing To that end, the cylinder head 6 comprises a threaded bore passing through it and opening into a combustion chamber of said engine 4. Concerning the body 8, this has a screw thread 16 on its other surface corresponding to the bore formed in the cylinder head 6. When the screw thread 16 cooperates with the threaded bore of the cylinder head 6, the glow plug 2 being in its mounted position in the engine 4, a portion of the body 8 extends inwardly of the engine 4, that is to say towards the combustion chamber, whereas another portion extends outwardly the engine.

The body 8 is a tubular body of steel within which are housed in particular the finger 10 and the core 12. The finger 10 projects from the tubular body 8 inside the combustion chamber. It is mounted with an interference fit inside the body 8 and receives a pre-heating electrode (not shown). The core 12 transmits electrical energy to the electrode situated in the finger 10 and, thereby, is in contact with that electrode and is connected to the finger 10 which it extends within the body 8. At the opposite end of the finger 10, the free end of the core 12 enables it to be electrically connected to a power conductor.

The pressure sensor is a piezo-electric sensor. It comprises a piezo-electric element 18 disposed between two contact elements 20 of electrically conductive material, the sensor itself being electrically insulated from the rest of the glow plug 2 by electrically insulating members 22. The pressure sensor 14 comes to bear on the body 8 via a bearing part 24. The other face of the sensor comes to bear against a nut 26 fastened to the upper end of the core 12. The part of the glow plug 2 where the pressure sensor 14 is to be found and which is situated outside the engine is also termed glow plug head. At this head, the body 8 has a gripping zone 28 used for the mounting/de-mounting of the glow plug 2 with respect to the cylinder head 6. Usually, this gripping zone 28 is cylindrical and of hexagonal cross-section. In this way, using a spanner, and obtaining access from the exterior of the cylinder head 6, the mounting and the demounting of the glow plug 2 are possible. The diameter of this gripping zone 28 is, in a conventional manner, greater than that of the rest of the body 8.

Figure 2:
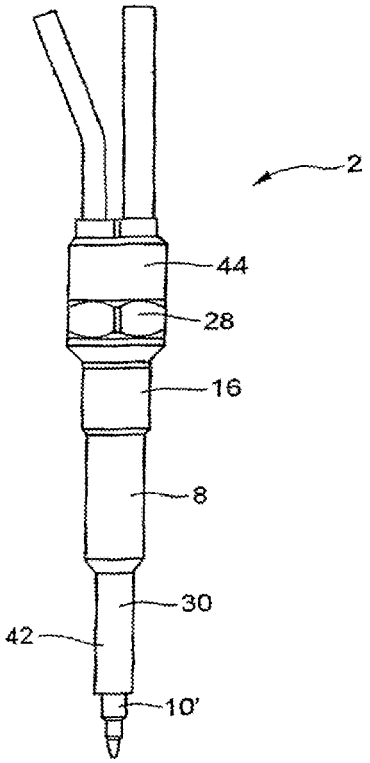
FIG. 2 represents a side view of a glow plug according to the invention.

FIG. 2 represents an external view of a glow plug according to the invention. With respect to the glow plug of FIG. 1, there is once again a body 8 having a screw thread 16 on its other surface. A gripping zone 28 can also be recognized on the head of the body 8. At the other end of the glow plug is a finger 10'. In the embodiment represented in the drawing it is a ceramic finger 10'. A first advantage of such a finger is to have a longer life than the fingers generally encountered for glow plugs of the prior art. It is also more compact in form. Thus, the finger 10' is very appreciably smaller than the finger 10 of FIG. 1.

Figure 3:
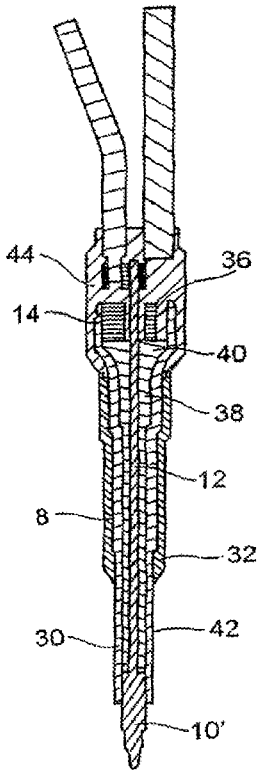
FIG. 3 represents the glow plug of FIG. 2 in longitudinal cross-section.
Figure 4:
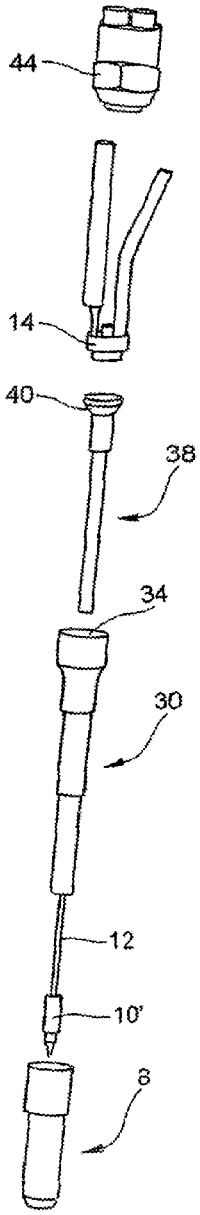
FIG. 4 is an exploded perspective view of the glow plug represented in FIGS. 2 and 3.

The glow plug of FIGS. 2 to 4 also comprises a pressure sensor 14. Here too this is a piezo-electric sensor which may be of the same type as the sensor of the glow plug represented in FIG. 1.

Whereas in FIG. 1 the finger 10 fits into the body 8, in the embodiment of FIGS. 2 to 4, in accordance with the invention, an intermediate tubular part 30 is provided between the body 8 and the finger 10'. This intermediate tubular part 30 is intended to isolate the finger 10' from the body 8.

An important difference between the sensors of the prior art and the sensor according to the invention described here is that the pressure sensor is no longer disposed between the body 8 and the finger 10 but is disposed between the finger 10' and the intermediate tubular part 30. This is apparent in particular in the cross-section of FIG. 3.

In the following portion of the description, it will be considered that the members intended to be located at the combustion chamber side when the glow plug is fixed into the engine are at a lower level than the members located outside the combustion chamber at the glow plug head side.

The finger 10' has an interference fit with the lower end of the intermediate tubular part 30. In a conventional manner, only the upper portion of the finger 10' is within the intermediate tubular part 30, the lower portion of the finger 10' projecting outside the part which carries it so as to be situated within the combustion chamber and to heat the gaseous mixture which is located therein.

The core 12 supplying the finger 10' with electrical energy passes through the entire intermediate tubular part 30.

The intermediate tubular part 30 is itself fixed with an interference fit to the lower end of the body 8 at a fixing zone 32. The end of the glow plug is also sometimes referred to as glow plug cone. Above the fixing zone 32 of the intermediate tubular part 30 on the body 8, the intermediate tubular part 30 extends freely within the body 8. In its upper portion, the intermediate tubular part 30 flares out and has a zone of greater diameter serving as a housing 34 for the sensor 14. In the glow plug, that sensor 14 is thus located at the head of the glow plug, that is to say in the upper portion thereof.

The upper portion of this housing 34 is tapped so as to be able to receive a nut having an outer screw thread. This nut 36 is provided to press on the upper face of the sensor 14. The lower face of the sensor 14 rests on a spacer 38. The latter links the finger 10' to the sensor 14.

The sensor 14 is for example a sensor of the type described with reference to FIG. 1. It is not useful to repeat the description of the sensor here. The important different between the sensor 14 of FIG. 1 and that of FIGS. 2 to 4 is that in FIG. 1 the sensor 14 works in tension whereas in FIGS. 2 to 4 is works in compression. This does not however modify its structure and in particular there is once again a piezo-electric element disposed between two contact elements to which electric wires are connected.

The spacer 38 is a tubular part to enable in particular the passage of the core 12 through its center. The outer diameter of the spacer 38 is adapted to the inner diameter of the intermediate tubular part 30 so as to extend freely therein. In its lower portion, the diameter of the spacer 38 is adapted to the diameter of the finger 10'. In its upper portion, the diameter of the spacer 38 is adapted to the diameter lower face of the sensor 14. Thus, as may be noted on the drawing, the spacer has a frusto-conical zone 40 in its upper portion making it possible to progressively pass from the diameter corresponding to the finger 10' to that of the sensor 14.

The pressure sensor 14 solely measures here the stresses arising from the ambient pressure in the corresponding combustion chamber. The variants stresses exerted on the cylinder head 6 in which the glow plug is mounted, in particular those which are not proportional to the ambient pressure in the combustion chamber, have no influence on the pressure measured by the sensor 14. This is because the intermediate tubular part 30 is held in the body 8 at a zone of the body which does not undergo the stresses linked to the deformation of the cylinder head 6 into which the glow plug 2 is screwed. More particularly, these deformations are rather to be found at the screw thread 16.

The sensor 14 is mounted between the intermediate tubular part 30 and the finger 10'. To obtain a correct measurement of the pressure exerted on the finger 10', care is taken in the design of the glow plug to provide a deformation zone 42 of the intermediate tubular part 30. This deformation zone 42 is located between the zone in which the finger 10' has an interference fit inside the intermediate tubular part 30, and the zone in which the intermediate tubular part 30 fits into the body 8. This deformation zone 42 favors the transmission of the forces exerted by pressure on the finger 10' of the sensor 14.

The role of the spacer 38 is important here and great attention must be taken in its manufacture. On passing on the forces exerted on the finger 10', the spacer 38 must not transmit parasitic forces. Care should therefore be taken that the spacer is in contact neither with the core 12 supplying the finger 10' with electrical energy nor with the intermediate tubular part 30.

Care should also be taken that the spacer's own vibration mode does not perturb the pressure measurement of the sensor 14. Care must therefore be taken that the own vibration frequency of that spacer 38 is far away from the bandwidth of the sensor 14. In choosing a ceramic as material for producing that spacer 38, these problems may be solved.

As shown in FIGS. 3 and 4, the head of the glow plug may comprise an overmolded part 44 of synthetic material. This part may incorporate the gripping zone 28 of the glow plug head. The overmolding with synthetic material makes it possible to ensure good fluid-tightness of the glow plug head and ensure good protection of the electrical connections of the electrical wires connected to the contact elements of the sensor 14.

A glow plug 2 comprising a pressure sensor 14 such as the glow plug described above makes it possible to make an excellent pressure measurement within a combustion chamber. The measurement of this pressure is totally decoupled from the parasitic noise liable to perturb the pressure measurement. Thus even where there are injectors situated at each cylinder, the pressure sensor mounted in a glow plug according to the invention makes it possible to get free from the deformations of the cylinder head induced by the stresses exerted by those injectors. As for the deformation zone on the intermediate tubular part, this makes it possible to obtain good sensitivity for the measurement made by the sensor.

As is apparent in particular from FIG. 4, despite the introduction of an intermediate tubular part, the glow plug according to the invention remains easy to assemble. It is a matter of stacking parts which are sealed by an overmolding of plastics materials at the glow plug head.

The present invention is not limited to the preferred embodiment described above by way of non-limiting example. It also concerns all the variant embodiments accessible to the person skilled in the art.

Thus, for example, the present invention may perfectly well be envisaged with a conventional finger. The drawing of the glow plug must then be adapted to that finger of greater size but it is of course still possible to introduce an intermediate tubular part to achieve the decoupling between the body of the glow plug and the finger thereof.

The fixing of the finger in the intermediate tubular part and respectively of the intermediate tubular part in the body is provided above by interference fit. Another way of fixing (welding, for example) may be envisaged.

An alternative to the use of a spacer may be envisaged. There may for example be provided a nut fastened to the core supplying the finger with electrical energy and on which the lower face of the pressure sensor would come to rest. To withstand the high mechanical forces to transmit, rigidifying that core may then have to be envisaged. If the spacer is kept, it may take a different form to that described above. That form is advantageous since it makes it possible to have only one part between the finger and the sensor. However, it would be possible to have a spacer associated with a washer for bearing upon which would form the interface between the spacer and the sensor.

The invention claimed is:

1. A glow plug (2) comprising:

a tubular body (8) having means (16) for fixing into a bore;

an intermediate tubular part (30) mounted in the tubular body (8);

a finger (10') arranged inside the intermediate tubular part (30) and configured to receive a heater electrode; and a pressure sensor (14) having a first face connected to the intermediate tubular part (30), the first face facing away from the finger (10'), wherein the pressure sensor (14) has a second face that faces the finger (10') and bears on the finger (10').

2. The glow plug (2) according to claim 1, wherein the intermediate tubular part (30) is connected to the tubular body (8) adjacent to the end of the tubular body (8) adapted to be in a combustion chamber of an engine (4).

3. The glow plug (2) according to claim 1, wherein the intermediate tubular part (30) is fixed to the tubular body (8) by an interference fit.

4. The glow plug (2) according to claim 1, wherein the intermediate tubular part (30) is welded to the tubular body (8).

5. The glow plug (2) according to claim 1, wherein the finger (10') is fixed to the intermediate tubular part (30) by an interference fit.

6. The glow plug (2) according to claim 1, wherein the finger (10') is welded to the intermediate tubular part (30).

7. The glow plug (2) according to claim 1, wherein the intermediate tubular part (30) includes a deformation portion (42) between a first fixing portion in which the finger (10') is connected to the intermediate tubular part (30) and a second fixing portion (32) in which the intermediate tubular part (30) is connected to the tubular body (8).

8. The glow plug (2) according to claim 1, wherein a spacer (38) is arranged between the finger (10') and the second face of the pressure sensor (14) inside the intermediate tubular part (30).

9. The glow plug (2) according to claim 8, wherein the spacer (38) is comprises a ceramic material.

10. The glow plug (2) according to claim 8, wherein the spacer (38) comprises an elongate tubular bush with an outer diameter less than an inner diameter of the intermediate tubular part (30), a terminal end of the tubular bush having a frusto-conical portion (40) adapted to come into contact with the pressure sensor (14) so as to present a bearing surface adjacent to the pressure sensor (14) substantially corresponding to a surface of the second face of the pressure sensor (14).

11. The glow plug (2) according to claim 1, wherein the pressure sensor (14) is placed in a housing (34) provided in the intermediate tubular part (30) adjacent to a first end of the tubular part, the first end being opposite to a second end of the intermediate tubular part (30) adapted to receive the finger (10'), and wherein the pressure sensor (14) is connected to the intermediate tubular part (30) by a nut (36) having an outer periphery with a screw thread configured to engage with a tapping at the first end of the intermediate tubular part (30).

12. The glow plug (2) according to claim 2, wherein the intermediate tubular part (30) is fixed to the tubular body (8) by an interference fit.

13. The glow plug (2) according to claim 2, wherein the intermediate tubular part (30) is welded to the tubular body (8).

14. The glow plug (2) according to claim 9, wherein the spacer (38) comprises an elongate tubular bush with an outer diameter is less than the inner diameter of the intermediate tubular part (30), a terminal end of the tubular bush having a frusto-conical portion (40) adapted to come into contact with the pressure sensor (14) so as to present a bearing surface adjacent to the pressure sensor (14) substantially corresponding to the surface of a surface of the second face of the pressure sensor (14).

15. The glow plug (2) according to claim 11, wherein the nut (36) connecting the pressure sensor (14) to the intermediate tubular part (30) is arranged to press on the first face of the pressure sensor (14).

16. The glow plug (2) according to claim 1, wherein the intermediate tubular part (30) extends through a first opening at a first end of the tubular body (8) and out from a second opening at an opposite second end of the tubular body (8).

17. The glow plug (2) according to claim 1, wherein the intermediate tubular part (30) separates an entire inner surface of the tubular body (8) from the finger (10).

* * * * *